United States Patent [19]

Wood

[11] 4,402,412

[45] Sep. 6, 1983

[54] MACHINES FOR CLASSIFYING PHARMACEUTICAL CAPSULES

[75] Inventor: Rex C. Wood, New Brighton, Minn.

[73] Assignee: Modern Controls, Inc., Elk River, Minn.

[21] Appl. No.: 218,658

[22] Filed: Dec. 22, 1980

[51] Int. Cl.[3] ..... B07C 5/06

[52] U.S. Cl. ..... 209/625; 209/571

[58] Field of Search ..... 209/625, 627, 631, 644, 209/571; 406/3, 155, 74

[56] References Cited

U.S. PATENT DOCUMENTS 3,625,357 12/1971 Ochs et al. ..... 209/625

3,746,163 7/1973 Ochs et al. ..... 209/625 X 3,785,487 1/1974 Spencer ..... 209/625 X 4,172,526 10/1979 Moser ..... 209/625

4,223,751 9/1980 Ayers et al. ..... 209/571 X

*Primary Examiner*—Robert B. Reeves

*Assistant Examiner*—Edward M. Wacyra

[57] ABSTRACT

A device for insertion into the flow line of a high speed capsule classifying machine, having a capsule receptacle mounted on a movable gate, and a control circuit for detecting nonuniform capsules on the receptacle to position the gate and thereby move the receptacle in front of an air pressure jet to remove the nonuniform capsule from the receptacle, and then reposition the receptacle back into the capsule flow line.

10 Claims, 4 Drawing Figures

MACHINES FOR CLASSIFYING PHARMACEUTICAL CAPSULES

BACKGROUND OF THE INVENTION

This invention relates to U.S. Pat. No. 4,223,751, issued Sept. 23, 1980, and entitled "High Speed Capacitance Apparatus for Classifying Pharmaceutical Capsules". In particular, the invention comprises an improvement to the machine disclosed in the aforementioned patent, which improvement enables the machine to classify capsules at an increased production rate.

The machine described in the aforementioned patent includes a hopper for holding a supply of capsules of a type and size commonly used in the pharmaceutical industry. The capsules in the hopper are conveyed to a turntable device which has a chute tangentially positioned along its circumference. Capsules are fed into the chute in a continuous stream, and the chute conveys the capsules into an air jet mechanism which propels them through a capacitive sensing device. The capacitance sensing device detects variations in weight of the capsules as they are propelled through the sensing device, and a mechanical deflector is energized to deflect capsules which fall outside of predetermined weight tolerances into a different trajectory than the trajectory of "good" capsules. The respective trajectories lead to collection receptacles wherein the "good" and "bad" capsules may be separately collected. The machine is designed to operate at very high rates of speed, and is capable of processing and weighing capsules at rates in excess of 2,500 capsules per minute.

While the aforementioned machine is capable of operating at high processing speeds, there has been a problem in the feed mechanism which is required to feed capsules in a continuous chain into the sensing device. Occasionally, a deformed or defective capsule, or a misaligned capsule, will move down the chute into the air jet propelling intake and will jam against the inlet of the air jet device and therefore stop the flow of the stream of capsules. In the past, when this circumstance occurred, it has been necessary for the operator to manually remove the nonuniform capsule to permit the capsule stream to continue. This has required continuous operator attention to the machine in order to facilitate maximum processing rate, and the time required for manual clearing of the problem capsules from the stream has resulted in an average processing rate slowdown.

SUMMARY OF THE INVENTION

The present invention provides an automatic clearing mechanism for removing problem capsules from the capsule stream without operator attention, and thereby to speed up overall processing rates in the operation of the machine. The improvement comprises a flow through passage inserted between the chute and air jet device, and having a capsule receptacle aligned with and positioned adjacent the chute. The capsule receptacle is mounted on a movable gate, and may be selectively positioned to an air jet port when a problem capsule is on the receptacle. The air jet port issues a blast of air to remove the problem capsule from the receptacle, and the gate repositions the receptacle back into capsule stream flow communication.

It is therefore a principal object of this invention to improve the overall processing speed of a high speed capacitance apparatus for classifying pharmaceutical capsules.

It is another object of the present invention to provide an apparatus for clearing a moving capsule stream of nonuniform capsules.

It is a further object of the present invention to provide a device for removing misaligned, deformed and defective capsules from a capsule stream automatically and without manual operator intervention.

BRIEF DESCRIPTION OF THE DRAWINGS

A preferred embodiment of the invention is disclosed in the following specification and claims, and with reference to the appended drawings, in which:

DESCRIPTION OF THE PREFERRED EMBODIMENT

Figure 1:
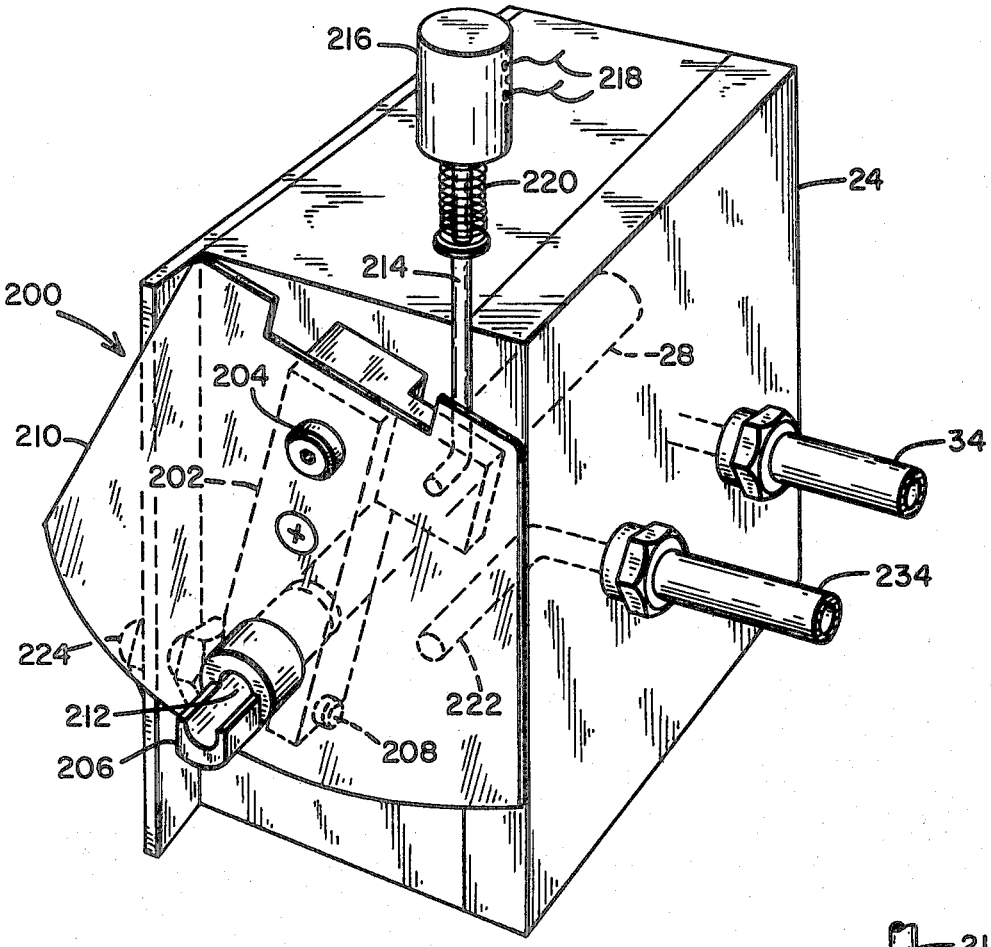
FIG. 1 is an isometric view of the invention.

Referring first to FIG. 1, the clearing mechanism 200 is shown in isometric view attached to an accelerator or air jet device 24. An L-shaped arm 202 is pivotal about a pin 204 which is threadably fastened to air jet device 24. The lower end of L-shaped arm 202 is clamped about tubular receptacle 206, which is secured by means of lock screw 208. Receptacle 206 passes through gate plate 210, which is generally fan-shaped and constructed of a thin metal or plastic sheet. Receptacle 206 has an axial bore 212 which passes completely through the receptacle and opens through the rear side of arm 202. In the position shown, bore 212 is in axial alignment with passage 28 through air jet device 24. Air jet device 24 has a number of additional air passages (not shown) which place passage 28 in air flow communication with air line 34. These additional passages, as well as their function, are disclosed in U.S. Pat. No. 4,223,751, and serve the purpose of imparting an axial velocity component to capsules passing through air jet device 24.

The other end of L-shaped arm 202 is connected to solenoid shaft 214. Solenoid shaft 214 is operatively retracted by solenoid 216, which may be electrically energized through wires 218. A spring 220 holds solenoid shaft 214 is an extended position when the solenoid 216 is deenergized.

Air line 234 is coupled to a passage 222 which opens through the side of air jet device 24. The distance between the opening of passage 222 and pin 204 is the same as the distance between pin 204 and the center line of bore 212.

Figure 3:
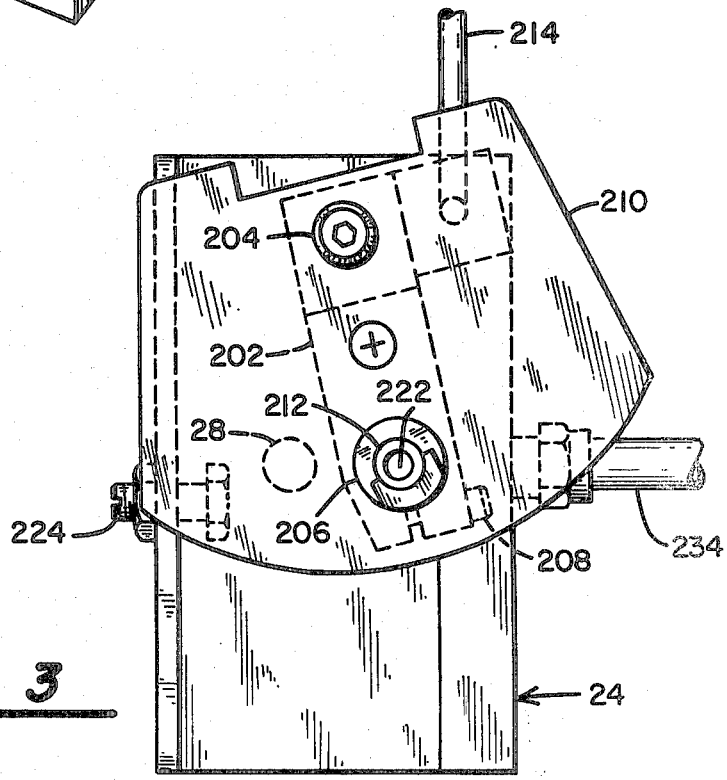
FIG. 3 is an end view of the invention taken along the lines 3—3 of FIG. 2.

Referring next to FIG. 3, the device is shown in end view in a plane normal to the axis of bore 212. In FIG. 3 solenoid 216 is energized and plate 210 is pivoted about pin 204 to a second predetermined position. In this position, bore 212 is axially aligned with passage 222, which is in air flow communication with air line 234. Also, in this position, plate 210 blocks passage 28 and prevents capsules from entering passage 28.

An adjustable mechanical stop 224 is set to limit the arcuate swing of L-shaped arm 202 when solenoid 216 is deenergized. Mechanical stop 224 is threadably adjusted so as to place bore 212 in axial alignment with passage 28 when solenoid 216 is deenergized.

Figure 2:
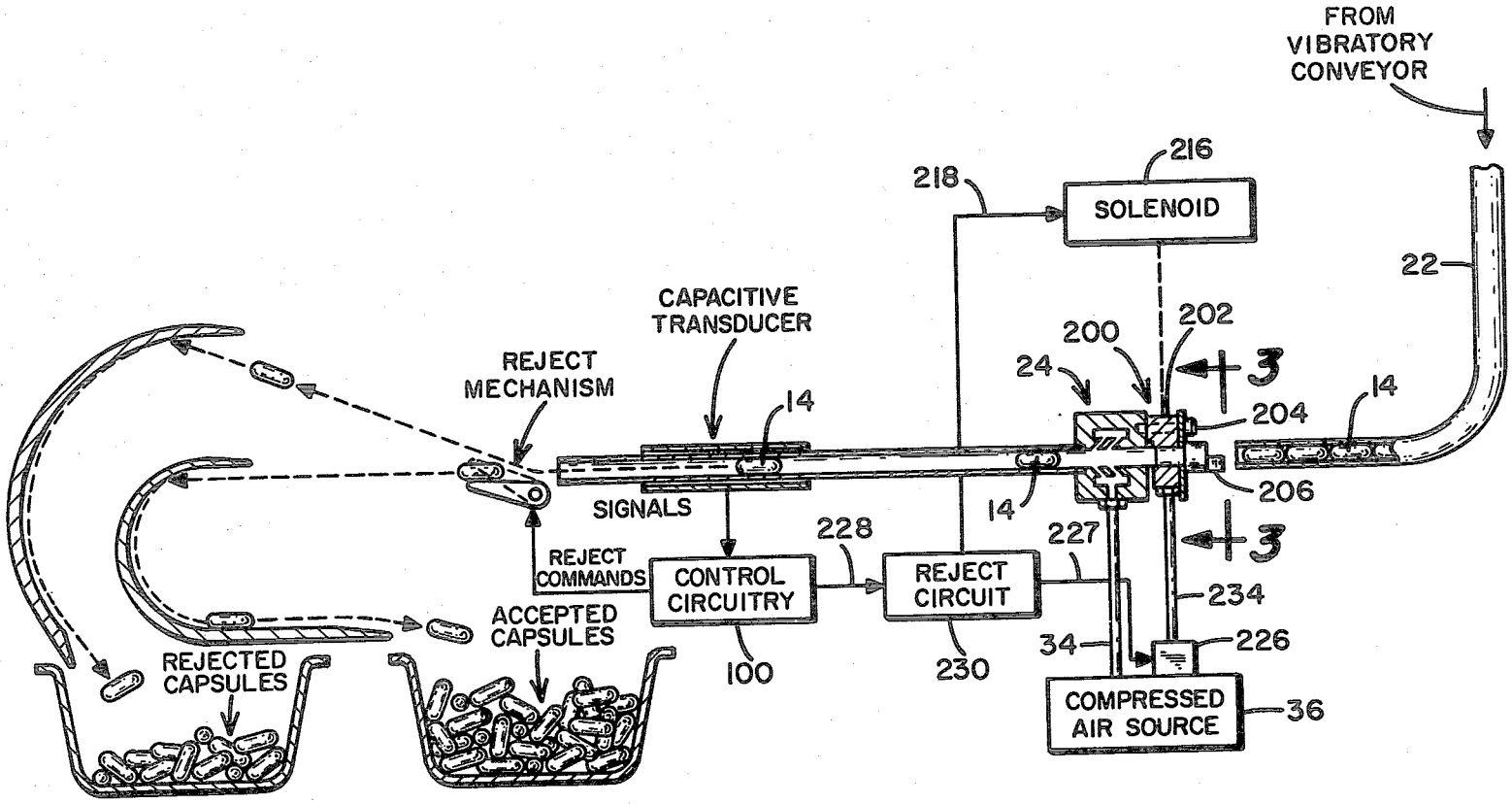
FIG. 2 is a schematic plan view in cross section.

FIG. 2 shows clearing mechanism 200 attached to air jet device 24 in an operable system. Capsules 14 pass in a continuous stream down chute 22, through receptacle 206 and air jet device 24 into the sensing and sorting mechanism. Solenoid 216 is actuated by a signal transmitted from reject circuit 230 over wires 218. A signal from control circuitry 100 over line 228 energizes reject circuit 230. Compressed air is supplied to air jet device 24 and clearing mechanism 200 from compressed air source 36. The compressed air supplied through line 34 is supplied in a continuous flow, while the compressed air supplied through line 234 is supplied in short, controllable blasts of air. The blasts of air are produced when a solenoid valve 226 is actuated by an electrical signal transmitted over lines 227 by reject circuit 230.

Figure 4:
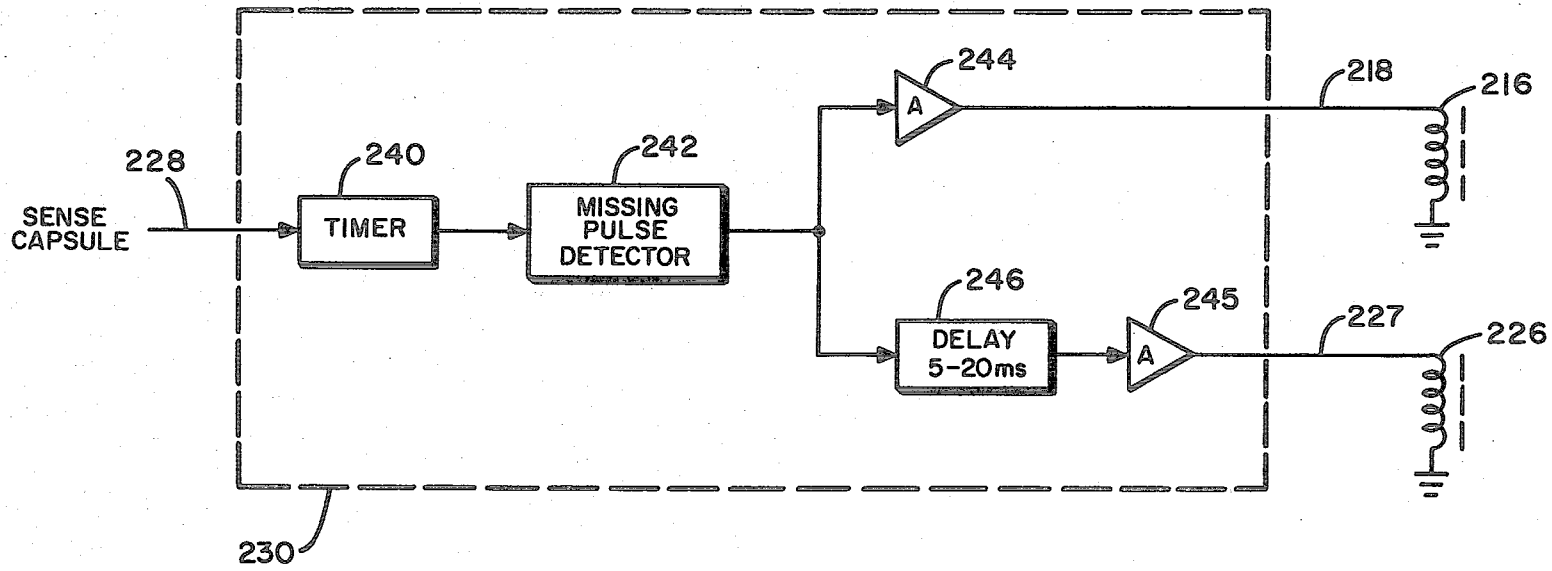
FIG. 4 is a symbolic diagram showing the electrical control circuit of the invention.

FIG. 4 shows a symbolic diagram of the electrical and electro-mechanical control circuit of the invention. The input to reject circuit 230 is a signal over line 28 indicative of a capsule sensed by the sensing and sorting mechanism disclosed in U.S. Pat. No. 4,223,751. This "sense capsule" signal occurs each time a capsule passes through the capacitive transducer disclosed in the aforementioned patent. The signal on line 228 is applied to a timer circuit, which preferably is a semiconductor circuit manufactured by Signetics Corporation of Sunnyvale, Calif. as type designation NE555. The output of timer circuit 240 is connected to a missing pulse detector 242, which generates a signal whenever a predetermined time lapses between the subsequent passing of capsules through the sensing and sorting mechanism. The predetermined time is preferably set to approximately ½ second, so that if a time delay of ½ second occurs between subsequent capsules the reject circuit 230 will become actuated. Timer 240 and missing pulse detector 242 are described in an applications brochure published by Signetics Corporation in 1973, at page 17. The output of missing pulse detector circuit 242 is connected to an amplifier 244 which generates sufficient drive current to energize solenoid 216. Solenoid 216 repositions gate plate 210 as has been hereinbefore described. The output of missing pulse detector 242 is also coupled to a time delay circuit 246, which may be any type of time delay circuit commonly known in the art capable of delaying an output signal for a time delay of 5–20 milliseconds (ms) after receipt of an input signal. The output of time delay 246 is coupled into an amplifier 245 which generates a current drive signal sufficient to energize solenoid 226. Solenoid 226 activates an air valve for introducing an air blast through air line 234 and passage 222.

In operation, the capsule classifying apparatus disclosed in U.S. Pat. No. 4,223,751 operates in a conventional manner until a capsule progressing along chute 22 becomes jammed in receptacle 206. This problem capsule interrupts the normal flow of capsules through the sensing and sorting mechanism which, after a predetermined time delay of approximately ½ second, causes a signal to be generated to the reject circuit 230. Reject circuit 230 generates a first signal to energize solenoid 216 and thereby reposition gate plate 210 and receptacle 206 to a position in alignment with passage 222, and subsequently energizes air solenoid 226 to permit a blast of air to pass through air line 234 into passage 222. This blast of air passes through receptacle 206 and against the problem capsule, thereby ejecting the capsule from the receptacle. Solenoids 216 and 226 then become deenergized, disconnecting the air blast from air line 234 and returning gate plate 210 and receptacle 206 back into an aligned position adjacent chute 222. This permits the flow of capsules through the apparatus to begin again, and continues until a subsequent nonuniform problem capsule is detected.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for removing deformed or misaligned capsules from a more or less continuous stream of moving capsules, comprising (a) means for propelling a plurality of capsules in an end-to-end stream of capsules;

(b) a pivotable gate having an opening therethrough, said gate being pivotable from a first position wherein said opening is in alignment with said stream to a transverse second position wherein said opening is arcuately displaced from said stream;

(c) a receptacle seated in said gate opening, said receptacle having a bore therethrough in alignment with said stream when said gate is in its first position, and said bore being sized to pass uniform capsules therethrough and to stop nonuniform capsules in said stream;

(d) a controllable air jet positioned in alignment with said receptacle bore when said gate is in its second position, said air jet being directed counter to the direction of movement of said stream; and (e) means for pivoting said gate between said first and second position and for actuating said air jet.

2. The apparatus of claim 1, wherein said means for pivoting said gate further comprises an actuator arm connected to said gate, and means for detecting a predetermined time delay in the passage of consecutive capsules in said stream of capsules, and for moving said actuator arm when said predetermined time delay is exceeded.

3. The apparatus of claim 2, wherein said means for actuating said air jet further comprises a solenoid-controlled air valve and means for energizing said valve when said gate is in said second position.

4. The apparatus of claim 3, further comprising a spring return urged against said gate, acting to return said gate to said first position when said gate actuator arm is released from movement.

5. The apparatus of claim 3, further comprising means for accelerating said capsules positioned adjacent said gate downstream along said capsule stream.

6. The apparatus of claim 5, wherein said means for accelerating further comprises air jets directed into a bore in the downstream direction, said bore being in axial alignment with said receptacle bore in said first position.

7. In a machine for classifying pharmaceutical capsules by weight by passing said capsules in an aligned stream through a capacitive sensor, the improvement comprising (a) means for propelling a plurality of capsules in an end-to-end stream of capsules through said machine;

(b) a movable gate attached to said machine, said gate having a plate-like surface and an opening therethrough, said gate being pivotally movable in a path transverse to the direction of movement of said capsule stream;

(c) a tubular receptacle in said opening, said receptacle having a bore therethrough sized to pass capsules in alignment and to stop capsules deformed or misaligned in said capsule stream;

(d) an air passage opening adjacent the transverse path of said gate;

(e) means for moving said gate to a first position wherein said receptacle bore is in alignment with said capsule stream and to a second position wherein said receptacle bore is in alignment with said air passage opening;

(f) means for actuating said gate moving means after a predetermined delay in passing successive capsules in said capsule stream through said capacitive sensor, said actuating means causing said gate moving means to move said gate to said second position; and (g) means for emitting a blast of air through said air passage opening in a direction opposite to the direction of movement of said capsule stream when said gate is in said second position.

8. The apparatus of claim 7, wherein said movable gate is pivotably mounted on said machine to cause said receptacle to move along an arcuate path between its respective first and second positions.

9. The apparatus of claim 8, further comprising adjustable stop means for setting said gate first position.

10. A method of ejecting nonuniform and misaligned capsules from a rapidly moving stream of mostly aligned and uniform capsules, comprising steps of:

(a) passing said moving capsule stream through a receptacle and gate sized to pass aligned and uniform capsules and stop misaligned and nonuniform capsules;

(b) pivotally moving said gate and receptacle to a transverse position away from said capsule stream when a capsule becomes stopped;

(c) passing a jet of air through said receptacle and gate in a direction opposite to the moving capsule stream to dislodge the stopped capsule; and (d) returning the receptacle and gate to the initial position.

* * * * *